US005432321A

United States Patent [19]

Gerl

[11] Patent Number: 5,432,321

[45] Date of Patent: Jul. 11, 1995

[54] OVEN WITH PREHEATING PHASE AND CONTINUED HEATING PHASE, AND INDEPENDENT PHASE INDICATORS

[75] Inventor: Josef Gerl, Palling, Germany

[73] Assignee: Bosch-Siemens Hausgeraete, Munich, Germany

[21] Appl. No.: 149,056

[22] Filed: Nov. 8, 1993

[30] Foreign Application Priority Data

Nov. 6, 1992 [DE] Germany ..... 42 37 570.3

[51] Int. Cl.[6] ..... H05B 1/02

[52] U.S. Cl. ..... 219/506; 219/508; 219/492; 219/487; 219/413

[58] Field of Search ..... 219/451–453, 219/483–487, 505, 506, 492, 494, 411–414

[56] References Cited

U.S. PATENT DOCUMENTS

| | | | |
|---|---|---|---|
| 1,626,663 | 5/1927 | Brace | 219/506 |
| 3,270,183 | 8/1966 | Jordon | 219/411 |
| 3,430,232 | 2/1969 | Martin | 219/506 |
| 3,808,402 | 4/1974 | Rea | 219/413 |
| 4,897,526 | 1/1990 | Anthony | 219/492 |
| 4,990,750 | 2/1991 | Martel et al. | 219/453 |
| 5,103,077 | 4/1992 | Goessler et al. | 219/453 |

FOREIGN PATENT DOCUMENTS

| | | |
|---|---|---|
| 0513721 | 11/1992 | European Pat. Off. . |
| 1015206 | 9/1957 | Germany . |
| 2757059 | 6/1979 | Germany . |
| 3204518 | 8/1983 | Germany . |
| 4003442 | 8/1991 | Germany . |
| 4029181 | 3/1992 | Germany . |
| 3921085 | 4/1992 | Germany . |
| 593411 | 10/1947 | United Kingdom . |
| 2114828 | 6/1986 | United Kingdom . |
| 818030 | 4/1981 | U.S.S.R. . |
| 886326 | 12/1981 | U.S.S.R. . |
| 1045414 | 9/1983 | U.S.S.R. . |

*Primary Examiner*—Mark H. Paschall

*Attorney, Agent, or Firm*—Herbert L. Lerner; Laurence A. Greenberg

[57] ABSTRACT

An oven includes a normal heating device, a partial heating capacity device, a first indicator device associated with the normal heating device, a second indicator device associated with the partial heating capacity device, and a control unit. The control unit turns on a full heating capacity of the normal heating device in a preheating phase and turns on the first indicator device to indicate that the normal heating device is on. The control unit turns on the partial heating capacity device in the preheating phase and turns on the second indicator device to indicate the preheating phase. The control unit automatically switches over the normal heating device to a reduced heating capacity in a continued heating phase, when a selected command temperature is reached. The control unit turns off the partial heating capacity device and automatically turns off the second indicator device simultaneously with the switchover to the continued heating phase.

4 Claims, 1 Drawing Sheet

OVEN WITH PREHEATING PHASE AND CONTINUED HEATING PHASE, AND INDEPENDENT PHASE INDICATORS

BACKGROUND OF THE INVENTION

Field of the Invention

The invention relates to an oven including a heating device, a control unit controlling the heating device for turning on a full heating capacity in a preheating phase and for automatically switching over to a continued heating phase with a reduced heating capacity, in dependence on a selected command temperature, and an indicator device for indicating the heating phase or mode.

In an oven known from German Published, Non-Prosecuted Application DE-OS 27 57 059, preheating of the oven takes place at a full heating output capacity during a preheating phase, after which a switchover automatically takes place to a continued heating phase with a lower heating capacity, before the selected command temperature of the oven has been reached. In ovens in general, all of the heating phases are indicated to the user, depending on the control tolerance of the temperature controller, by activating some indicator device, such as an indicator light, during those heating phases, which goes out: when the heating is switched off.

SUMMARY OF THE INVENTION

It is accordingly an object of the invention to provide an oven, which overcomes the disadvantages of the heretoforeknown devices of this general type and which provides means for informing the user of a heating-up state as soon as possible after the oven is turned on. It is moreover an object to shorten the actual heating-up time.

With the foregoing and other objects in view there is provided, in accordance with the invention, an oven, comprising a normal heating device; a partial heating capacity device; a first indicator device associated with the normal heating device, a second indicator device associated with the partial heating capacity device; and a control unit, the control unit turning on a full heating capacity of the normal heating device in a preheating phase and turning on the first indicator device to indicate that the normal heating device is on in a heating mode; the control unit turning on the partial heating capacity device in the preheating phase and turning on the second indicator device to indicate the preheating phase; the control unit automatically switching over the normal heating device to a reduced heating capacity in a continued heating phase or mode, when a selected command temperature is reached; and the control unit turning off the partial heating capacity device and automatically turning off the second indicator device simultaneously with the switchover to the continued heating phase or mode.

In accordance with another feature of the invention, there is provided a fast-heating switch device being manually actuated for adding the heating capacity of the partial heating capacity device to various heating modes.

In accordance with a concomitant feature of the invention, there is provided an ambient air blower, the partial heating capacity device being an ambient air heating body being associated with the ambient air blower for adding to the heating modes, wherein the heating modes include an ambient air mode and top and/or bottom heating mode.

Unlike known ovens in which an indication of the end of the heating-up time does not take place until the oven heating is turned off and is therefore at an oven temperature that is considerably above the selected command temperature (transient response of the temperature course), according to the invention the indication, for instance a visual display, takes place when the command temperature is attained, or in other words still during the heating operation. In this way the user can put the item or items to be baked, such as a cake, into the preheated oven at the earliest possible moment, not the least of which also saves energy. A further energy savings is achieved because once the command temperature is at least approximately reached, not only is the end of the heating-up phase signaled, for instance by the extinguishing of a signal light, but at the same time the high preheating capacity is also reduced or turned off, and the oven is then operated only at a reduced continued heating capacity.

In order to speed up the heating up of the oven overall, a special partial heating capacity is provided for fast heating, which can be selectively turned on in conjunction with any heating mode.

Other features which are considered as characteristic for the invention are set forth in the appended claims.

Although the invention is illustrated and described herein as embodied in an oven, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
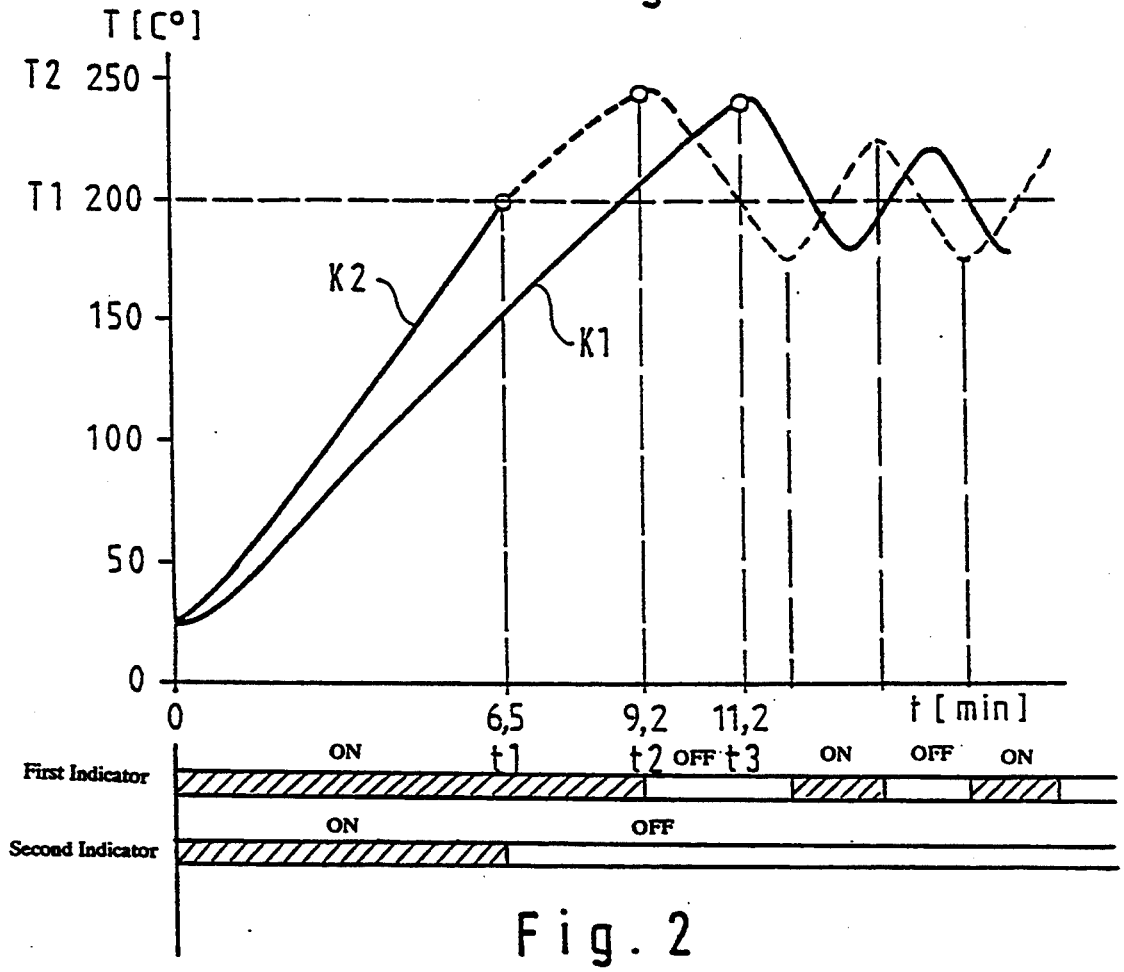
FIG. 1 is a temperature-time diagram which clearly illustrates a heating-up process.

Referring now to the figures of the drawing in detail and first, particularly, to FIG. 1 thereof, there is seen a diagram of a time-temperature course during heating up of a non-illustrated oven or of its oven box which is closeable by a door, and during an ensuing continued heating phase. A curve K1 shows the course in a conventional oven, and it can be seen that upon preheating with the maximum heating capacity output of the oven, at a preselected command temperature or oven temperature T1 of 200° C., for instance, the oven temperature which is actually measured initially overshoots the command temperature T1. It is not until a substantially higher overshoot temperature T2 occurs at a time t3 that the oven heating is turned off, followed by a phase of reduced heating capacity in a continued heating phase after the time t3 with a sinusoidal swing of the temperature course back and forth across the command temperature T1. At the time t3, an indicator device, which is constructed as an oven light, for instance, goes out, which signals the user that the oven then has the proper command temperature so that an item or items to be baked, for instance a cake, can be put in the oven. In other words, this signals that the preheating process is ended.

A curve K2 shows the temperature-time course in the oven when a special partial heating capacity is used in addition to the normal oven heating for the preheating phase. It can be seen that this curve course is steeper. In other words, the command temperature T1 is reached in a substantially shorter time t1 of 6.5 minutes, for instance. At this time t1, with the command temperature T1 being at least approximately reached, a switchover from the preheating phase to the continued heating phase is made automatically by the oven control unit. In other words, the aforementioned partial heating capacity is turned off, and the overshoot temperature T2 at the time t2 is reached at a reduced heating capacity, after which this heating capacity is also turned off and the thermostatic control process takes place. Simultaneously with the switchover from the preheating phase to the continued heating phase, or in other words upon attainment of the command temperature T1, a special additional indicator device, for instance once again in the form of a light, goes out, thereby signaling the user that the preheating phase is then ended, at a substantially earlier time t1, and the material to be baked can be placed in the oven. The curve courses, especially the course of the curve K2, clearly shows that in this way a substantial reduction of the preheating phase that is apparent to the user, at least by the time difference between t1 and t2, is achieved. By associating a special partial heating capacity with the preheating phase, the time savings achieved becomes even greater, namely by the time difference between t1 and t3.

Figure 2:
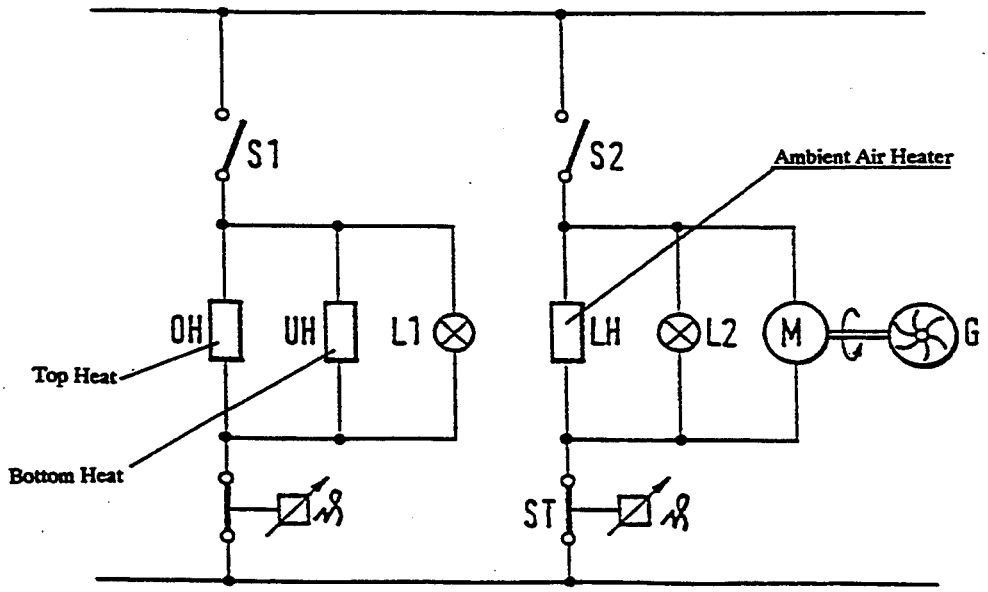
FIG. 2 is a simplified schematic circuit diagram of a control unit of the oven.

The elements of the oven that are essential to comprehension of the invention are clearly shown in the circuit diagram of FIG. 2, which is in simplified form. Reference symbol OH indicates a normal top heating device of the oven, for instance in the form of an internal radiant heating body, and reference symbol UH indicates a normal bottom heating device of the oven, which may be located outside the oven, for example. The oven also has an ambient air blower G, which is driven by an electric motor M and is surrounded annularly, for instance, by an ambient air heating body LH. This ambient air heating body LH represents the afore-mentioned partial heating capacity for the preheating phase, while the other heating bodies of the top and bottom heating devices serve to heat up the oven during the preheating phase and during the continued heating phase. An indicator device, for instance in the form of a light, is indicated by reference symbol L1. The indicator device is turned on during the thermostatically controlled operation of the normal heating capacities or devices OH and UH, or only during operation of the ambient air blower G, and goes out when this heating capacity of the device LH is turned off. Reference symbol L2 indicates a further indicator device which, for instance, is once again in the form of a light, that is assigned directly to the partial heating capacity device LH used in the heating-up phase. In other words, it is activated when the partial heating capacity device LH is turned on and goes out when this partial heating capacity device is turned off. Located in the power or current branch of this additional partial heating capacity device is a further temperature-dependent switch ST, or a second control path of a common thermostat, which turns off the partial heating capacity device LH and therefore the indicator device L2 as well, depending on the temperature prevailing in the oven, or in other words upon attainment of the command temperature, such as T1 in FIG. 1. The normal heating bodies OH, UH can be turned on through the use of a manually actuated switch S1. A switch S2, which is likewise actuatable by hand, is identified as a fast-heating key, for instance, and serves to carry out a fast heating process. With the actuation of this switch S2, the additional partial heating capacity device LH is turned on and is then turned off again when the command temperature T1 is reached.

I claim:

1. An oven with a preheating phase and a continuous heating phase with reduced heating capacity, comprising:

a heating device;

a partial heating capacity device switchable independently of said heating device;

a first indicator device associated with said heating device, a second indicator device associated with said partial heating capacity device; and a control unit, said control unit turning on a full heating capacity of said heating device at a start of any heating phase and turning on said first indicator device to indicate that said heating device is on and the heating phase has started;

said control unit turning on said partial heating capacity device in the preheating phase and turning on said second indicator device to indicate the preheating phase;

said control unit automatically switching off said partial heating capacity device to reduce a heating capacity in a continued heating phase during which only said heating device but not said partial heating capacity device is actuated, when a selected command temperature is reached;

said control unit switching said heating device in the continued heating phase such that the temperature oscillates about the selected command temperature; and said control unit automatically turning off said second indicator device simultaneously with the switchover to the continued heating phase.

2. The oven according to claim 1, including a fast-heating switch device being manually actuated for adding the heating capacity of said partial heating capacity device to various heating modes.

3. The oven according to claim 2, including an ambient air blower, said partial heating capacity device being an ambient air heating body being associated with said ambient air blower for adding further heat to the heating modes.

4. The oven according to claim 3, including an oven cavity with a bottom and a top, wherein the heating modes include an ambient air mode and at least one of top and bottom heating mode.

* * * * *